US006116802A

United States Patent [19]

Gueret

[11] Patent Number: 6,116,802

[45] Date of Patent: Sep. 12, 2000

[54] DEVICE FOR PACKAGING AND APPLYING A CRUMBLEABLE PRODUCT

[75] Inventor: Jean-Louis H. Gueret, Paris, France

[73] Assignee: L'Oreal, Paris, France

[21] Appl. No.: 09/070,718

[22] Filed: May 4, 1998

[30] Foreign Application Priority Data

May 5, 1997 [FR] France ..... 97 05587

[51] Int. Cl.[7] ..... A45D 40/02

[52] U.S. Cl. ..... 401/98; 401/86; 401/78

[58] Field of Search ..... 401/78, 86, 98

[56] References Cited

U.S. PATENT DOCUMENTS

| | | | |
|---|---|---|---|
| 4,168,128 | 9/1979 | Fillmore et al. . | |
| 4,514,102 | 4/1985 | Ackerman et al. | 401/98 |
| 4,961,663 | 10/1990 | Iwamoto et al. | 401/86 |
| 5,533,823 | 7/1996 | Pierpont et al. . | |

FOREIGN PATENT DOCUMENTS

| | | | |
|---|---|---|---|
| 0 070 257 | 1/1983 | European Pat. Off. . | |
| 0 250 373 | 12/1987 | European Pat. Off. . | |
| 0 617 905 | 10/1994 | European Pat. Off. . | |
| 1410397 | 8/1965 | France | 401/98 |
| 24 43 836 | 4/1976 | Germany . | |
| 54-5175 | 3/1979 | Japan . | |
| 57-44885 | 10/1982 | Japan . | |
| 1-35684 | 10/1989 | Japan . | |
| 2-33694 | 9/1990 | Japan . | |
| 2-38650 | 10/1990 | Japan . | |
| 2-38653 | 10/1990 | Japan . | |
| 3-17782 | 4/1991 | Japan . | |
| 5-6896 | 2/1993 | Japan . | |
| 6-48089 | 2/1994 | Japan . | |
| 8-228832 | 9/1996 | Japan . | |
| 9-56465 | 3/1997 | Japan . | |
| 9-70315 | 3/1997 | Japan . | |
| 658922 | 10/1951 | United Kingdom . | |
| 803383 | 10/1958 | United Kingdom . | |
| 2 135 247 | 8/1984 | United Kingdom . | |

*Primary Examiner*—Charles R. Eloshway
*Attorney, Agent, or Firm*—Oblon, Spivak, McClelland, Maier & Neustadt, P.C.

[57] ABSTRACT

A device for packaging and applying a crumbleable solid product in the form of a stick, includes a case of with a longitudinal axis, a first end of which includes a free edge delimiting an exit orifice for the product, a cup supporting the stick inside the case, a drive mechanism capable of causing the cup to slide axially in the case, a cap which is removable so that it can close off the exit orifice, the cap being closed at one of its ends, a first seal provided in the closed end of the cap, the first seal having a face which is substantially leaktight to the product, and which is intended to rest against the free edge of the case when the cap is held fixed on the case, wherein the first seal comprises at least one block of a cellular material which is elastically compressible in many directions, so as to allow the sealed face to interact in a sealing way with the free edge of the case, irrespective of the profile of the edge.

25 Claims, 3 Drawing Sheets

DEVICE FOR PACKAGING AND APPLYING A CRUMBLEABLE PRODUCT

BACKGROUND OF THE INVENTION

1. Field of the Invention

The present invention relates to a device for applying a crumbleable solid product, presented in the form of a stick and mounted so that it can slide in a case. This solid product is, for example, a stick of coloured or colourless lipstick, of foundation, of eye shadow, of blusher or alternatively a skin-care stick for the selective treatment of certain afflicted parts of the skin or lips. More specifically, the invention is aimed at an applicator device which is particularly well-suited to sticks that contain, in particular, water or volatile ingredients such as volatile oils containing silicone or hydrocarbons.

2. Description of the Related Art

Typical lipstick applicators comprise a tubular case in which a stick-holding cup capable of sliding axially in the case is mounted, the base of the stick of crumbleable solid product being fitted into the cup. In the conventional way, such a lipstick applicator further comprises drive means, for example a rotating thumbwheel, via which the user can slide the cup in the case to make the stick protrude or to retract it as desired. After the applicator has been used, it is closed with a cap held fixed on the case.

When the crumbleable solid product contains, among other ingredients, volatile compounds such as alcohol or volatile oils containing hydrocarbons or silicones, or alternatively water, it is desirable to limit or even prevent the evaporation of the volatile compounds of the stick of product in order to conserve the product's properties. Furthermore, some ingredients of the solid product may be sensitive to oxygen and their degradation may detract from the properties of the product. It is therefore desirable to reduce, or even to prevent, contact between the stick of product and the surrounding air. Therefore, it is necessary to reduce the volume of air in contact with the stick of product in the case when the applicator is closed and to keep this reduced volume of air constantly sealed so as to prevent renewal of air in the reduced volume.

To limit the contact between the stick of product and the surrounding air, U.S. Pat. No. 5,533,823 describes an applicator as previously defined equipped with a sealing sleeve tube in the form of bellows, in a closed end of the cap. The free end of the bellows defines a sealing surface intended to cover the open end of the case when the applicator is closed by the cap held fixed on the case. However, the bellows allows only an axial movement of compressing or expanding the sleeve tube and the sealing surface can move only in this axial direction. To close the open end of the case in a sealed manner, the bellows has to be compressed uniformly over its entire periphery, and this means that the free end of the bellows has to rest on the open end of the case. In order to uniformly compress the bellows, the cap has to be correctly positioned on the case when the latter is closed by the cap. When the user shuts the applicator quickly, the cap is not necessarily correctly positioned on the case and the free end of the bellows does not rest over the entire open end of the case. The bellows therefore does not compress correctly and sealing is not satisfactorily ensured over the entire periphery of the open end of the case.

Furthermore, commonly used cases do not necessarily have an opening with an edge that defines a plane perpendicular to the axis of the case. For example, the edges of cases may have undulations or define a plane which is inclined with respect to the axis of the case. The bellows described in U.S. Pat. No. 5,533,823 does not compress in such a way that its free end follows these particular profiles. Therefore, it is unsuited to the sealed closure of cases which have these particular profiles. In this case, contact between the free end of the bellows and the open end of the case is not sealed against the air and against the volatile products which may be present in the stick of product.

U.S. Pat. No. 4,168,128 teaches an applicator for a liquid product, comprising a sealing system in the form of a piece of foam placed in the cap so as to prevent leaks of product, when the applicator is closed by the cap. This applicator is of the type in which application is by transfer using a roller that rotates in a casing, the roller being pressed onto the surface to be treated. This arrangement requires fitting of the foam and shaping "in situ", which is disadvantageous from the industrial point of view and difficult to master from the technical point of view.

SUMMARY OF THE INVENTION

The object of the present invention is to propose an applicator for crumbleable solid product, which is perfectly sealed, particularly against the volatile ingredients in the product, irrespective of the profile of the open end of the case. Another object is to propose a sealing system which is economically advantageous and simple to fit.

According to the invention, these and other objects are achieved by producing an device comprising a case which has a longitudinal axis, a first end of which comprises a free edge delimiting an exit orifice for the product, a cup supporting the stick inside the case, drive means capable of causing the cup to slide axially in the case, a cap which is removable so that it can close off the exit orifice, the cap being closed at one of its ends, a first sealing means being housed in the closed end of the cap, the first sealing means having a face which is substantially leaktight to the product, and which is intended to rest against the free edge of the case when the cap is held fixed on the case. According to the invention, the first sealing means comprises at least one block of a cellular material which is elastically compressible in many directions, so as to allow the sealed face to interact in a sealing way with the free edge of the case, irrespective of the profile of the edge.

Thus the block of cellular material used to produce the means of sealing the opening of the case, by virtue of its cellular construction and its capability for elastic deformation, adapts perfectly to the deformation created by the sealed face of the block of cellular material resting against the edge of the opening of the case. It thus allows the sealed face to rest correctly against this edge and the sealed face perfectly follows the profile of the edge, providing a perfect seal around the opening of the case irrespective of the profile of this edge. Furthermore, such a sealing means makes it possible to obtain a good seal irrespective of the angular position of the cap relative to the case.

According to one embodiment of the device of the invention, the sealed face of the first sealing means may be capable of deforming in such a way that when the cap is fixed on the case, the region of the sealed face that rests on the free edge of the case has an annular depression. In particular, this depression may have a profile, in section on a plane parallel to the axis of the case. For example, the deformation of the annular depression, measured along this axis may range from about $5/100^{ths}$ of a mm to 5 mm, preferably from 0.1 mm to 3 mm and more preferably from 0.5 mm to 2 mm.

To maintain perfect seal, the case may comprise a second end opposite the free edge and a second sealing means forming a seal between the stick and the second end.

Preferably, the case comprises an internal surface and the second sealing means may comprise a member situated under the cup, with which it moves axially, the member being capable of rubbing in a sealed manner against the internal surface of the case.

According to a first embodiment of the invention, the device may comprise an internal skirt having at least one axial slot passing through the skirt, the skirt being mounted to rotate freely inside a casing which has an internal surface that comprises at least one helical groove capable of accommodating at least one stub borne by the cup, wherein the drive means for making the internal skirt rotate relative to the casing, is provided through the axial slot. In this embodiment, the second sealing means may comprise a seal placed near the second end, between the casing and the internal skirt.

According to a second embodiment of the invention, the case of the device may comprise a sheath, the cup comprising a central rod with an external screw thread, the drive means being capable of rotating the rod with respect to the sheath. In this embodiment, the second sealing means may comprise a seal placed between the cup and the sheath.

The sealed face of the first sealing means may be deformable in the direction of at least one axis approximately parallel to the axis of the case, so as perfectly to follow the relief of the edge of the opening of the case. It may also be deformable biaxially, that is to say in at least two directions, it being possible for one of the directions to be approximately parallel to the axis of the case, it being possible for the other direction to be more or less perpendicular to this axis.

The sealed face, held on the block of cellular material, may have a surface with any sort of profile that does not detract from the sealing function of the sealed face. In particular, the surface may be planar in a plane either perpendicular to or inclined with respect to the axis of the case, or alternatively, the surface may be concave or convex.

As the sealed face perfectly follows the edge of the opening of the case, it therefore has good flexibility. Furthermore, if the user of the applicator device actuates the drive means causing the cup to move in the case, the upper part of the stick B of lipstick will come into contact with the sealed face of the first sealing means according to the invention. However, since the sealing face is flexible, it deforms following the shape of that part of the stick which is in contact with it, and the stick is not damaged. Thus the first sealing means allows the stick of lipstick to keep its shape thus preventing any aesthetic damage to the stick when the device is actuated while it is closed.

According to the invention, the sealed face of the first sealing means needs to be sealed against the product, that is to say that it does not allow the volatile products that may emanate from the stick of product housed in the case of the device to pass. According to a first embodiment of the sealed face, the latter may be a membrane of cellular material with closed cells to make the membrane sealed. In particular, the cellular material of the membrane may be identical to that of the block of cellular material; in this case, the membrane may form an integral part of the block of cellular material. In another embodiment, the sealed face may be a membrane made of a different material from the cellular material of the block of cellular material. The membrane may be fixed to the block of cellular material by any fixing means known to those skilled in the art, and particularly by bonding or welding.

The block of cellular material has a first cross-section, and the sealed face of the first sealing means has a second cross-section, these cross-sections being measured on a plane perpendicular to the axis of the case. Preferably, the first cross-section, at least over part of the axial height of the block, is less than or equal to the second cross-section, thus allowing the sealed face to be held well by the block of cellular material.

The first and second cross-sections, which may be identical or different, may be of any shape and in particular in triangular, square, polygonal and circular shape.

The larger of the first and second cross-sections may be approximately equal to the internal cross-section of the cap or alternatively occupy just part of the internal cross-section of the cap. In the latter case, there may be an annular space between the first sealing means and the internal surface of the cap. This annular volume has the advantage of leaving space free to allow the block of cellular material and the sealed face to deform in a direction approximately perpendicular to the axis of the case, making it easier for the sealed face and for the block of cellular material to deform to provide sealed closure of the opening of the case. Furthermore, assuming that the block of cellular material is impregnated with water or with solvent, in order to keep the product in a solvent-rich atmosphere, this annular space allows the solvent to pass towards the product.

The block of cellular material may have a cross-section, in a plane parallel to the axis of the case, of any shape, and particularly in a straight-across, trapezoidal, or inverted bitrapezoidal (or diabolo) shape.

The block of cellular material of the first sealing means may be produced in one or more parts, it being possible for each part of the block of cellular material to be made of an identical or different cellular material. Thus, the first sealing means may consist of an axial stack of various blocks of cellular material which may have different density and/or thickness and/or type characteristics. Alternatively, the various blocks of cellular material are arranged concentrically.

The cellular material of the block and of the closed-cell membrane constituting the sealed face may be chosen independently of one another, from polyethylene, polyvinyl chloride, polyurethane, polyether and silicone foams.

The membrane that forms the sealed face may also be a film chosen from plastic films, aluminium films, complex metalo-plastic films, ceramic-plastic films, and leather. In particular, the plastic film may be chosen from elastomers, polyethylenes, polypropylenes, EVA, or be made of EVOH.

The invention also relates to a lipstick applicator comprising a device as previously described.

Apart from the provisions explained hereinabove, the invention consists in a certain number of other provisions which will be explained hereinbelow, with regard to some non-limiting embodiments described with reference to the appended figures.

DETAILED DESCRIPTION OF THE PREFERRED EMBODIMENTS

Figure 1:
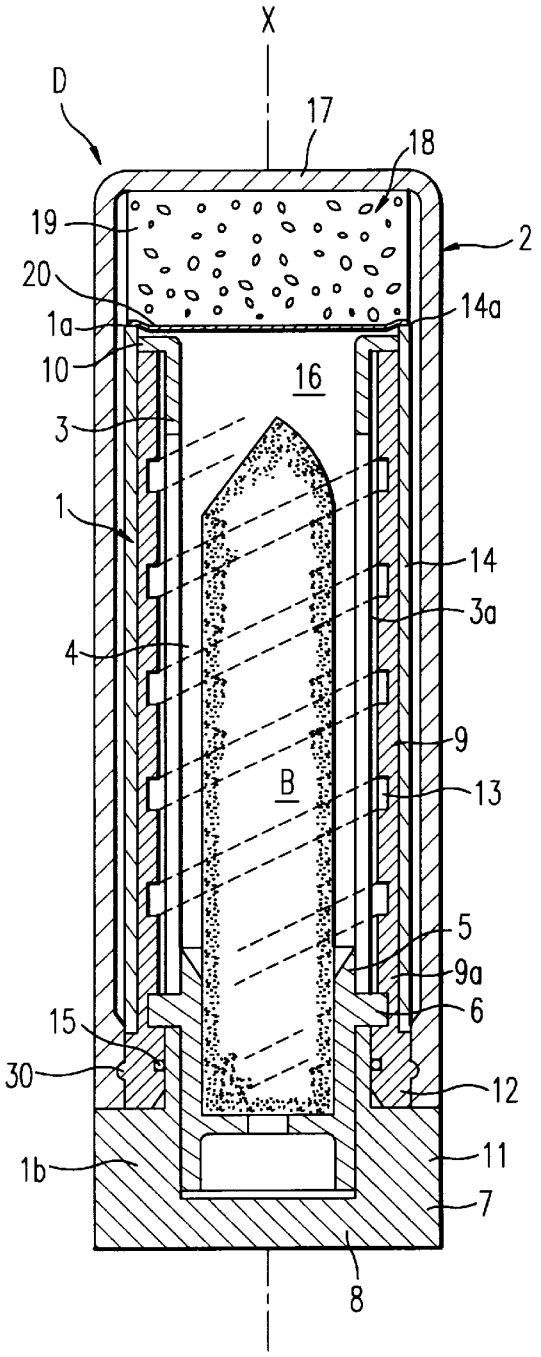
FIG. 1 is a longitudinal section through a dispenser in accordance with a first alternative form of the invention.

Referring to FIG. 1, it is possible to see a device D for applying a lipstick presented in the form of a stick B of crumbleable product. The device D comprises a case 1 which has an axis X and a cap 2 held fixed on the case 1.

The case 1 has a first end 1*a* which is open defining an exit orifice 16 for the stick B. This case 1 is equipped with a cylindrical internal skirt 3 with slideways 4 consisting of an axial slot extending more or less from the bottom to the top in the direction of the axis X. As a preference, two diametrically opposed axial slots 4 are provided.

A cup 5 is mounted so it can slide inside the internal skirt 3. The base of the stick B of lipstick is accommodated and held firmly in the cup 5. This cup, which is cylindrical in shape, has two diametrically opposed stubs projecting in a radial direction with respect to the axis X. The stubs 6 are engaged in the axial slots 4 and pass through these slots, emerging from the outer surface 3*a* of the internal skirt 3.

Under the slots 4, the internal skirt 3 is extended by a cylindrical base 7, itself closed at its lower end by a transverse end wall 8. The base 7 closes off a second end 1*b* of the case 1.

A slim casing member 9 made of plastic is fitted over the internal skirt 3. The casing member 9 is held axially, at the top, by a rim 10 of the internal skirt 3 which is negotiated, as the casing member 9 is fitted over the internal skirt 3, by deformation of this skirt 3.

The base 7 forms with the internal skirt 3 a shoulder 11 against which the lower end 12 of the casing member 9 comes to rest. Thus, the casing member 9 is axially immobilized between the shoulder 11 and the rim 10, but it is free to rotate relative to the internal skirt 3.

On its internal wall 9*a* the casing member 9 has two helical grooves 13 which are offset by 180°, and in which the free ends of the stubs 6 are engaged. The grooves 13 open out at the bottom 9*a* of the casing member 9 to allow, in particular, the stubs 6 to engage. An outer sleeve 14, generally made of metal and cylindrical in shape, with an edge 14*a*, surrounds the casing member 9 and is secured to the casing member 9. The edge 14*a* of the sleeve 14, in combination with the rim 10, delimits the orifice 16 via which the product exits the case 1.

An annular seal 15 is placed between the internal wall 9*a* of the casing member 9 and the outer surface 3*a* of the internal skirt 3, close to the shoulder 11 of the base 7, proximate to the second end 1*b* of the case 1. The annular seal 15 provides a seal between the stick B and the second end 1*b* of the case 1.

The cap 2 has a closed end 17 in which there is housed a first sealing means 18 comprising a block 19 of cellular material. This block of cellular material 19 has a sealed face 20 made of a material other than that of the block of cellular material. The sealed face 20 is, for example, a film fixed to the block of cellular material 19 especially by bonding. The block of cellular material 19 and the sealed face 20 have a good capability for deformation under stress.

Figure 8:
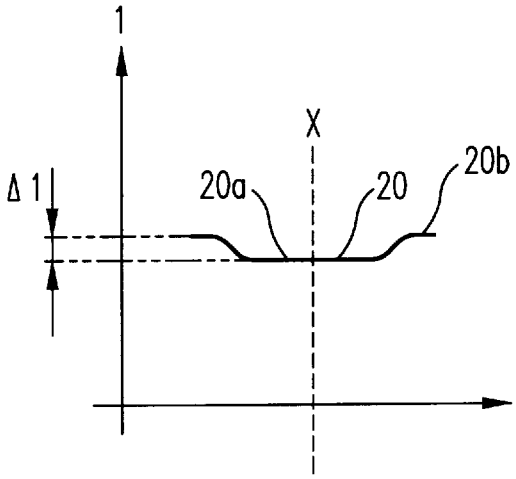
FIG. 8 is a curve depicting the profile of the deformation of the sealed face of the first sealing means resting against the free edge of a case.

When the device is closed, the cap 2 is held fixed on the case 1 by a bead/annular groove fixing means 30. The sealed face 20 of the block of cellular material 19 rests on the edge 14*a* of the sleeve 14 of the case 1 and the block of cellular material 19 compresses at least partially on account of its cellular structure. The sealed face 20 is flexible enough to follow the profile of the edge 14*a* perfectly and provide a very good sealing of the orifice 16 of the case 1. The block of cellular material 19, in compressing, perfectly follows the deformation of the sealed face 20 in contact with the edge 14*a*. The deformation of the sealed face 20 may, for example, be substantially cup-shaped as shown in FIG. 8, wherein the annular region 20*b* of the sealed face 20, which rests on the edge 14*a*, defines an annular depression Δ1 with respect to the region 20*a* lying inside the orifice 16 of the case 1. This depression Δ1 may range from 0.05 mm to 5 mm depending on the flexibility on deformation of the block of cellular material 19 and of the sealed face 20.

Thus, in such a closed device, the stick B of lipstick is housed in a volume delimited by the internal skirt 3, the sealed face 20 closing off the orifice 16 of the case and the cup 5. This volume is sealed, on the one hand, at its top by the sealed face 20 resting on the edge 14*a* of the sleeve 14 and, on the other hand, at its bottom, by the seal 15. This airtight volume prevents the volatile compounds which may be present in the lipstick from evaporating and limits contact between the product and the air: it therefore allows the product to keep well over time. In the embodiment just described, the seal 15 lies between the internal skirt 3 and the casing member 9. In an alternative form, the casing member 9 does not come down as far as the end 1*b*, and the seal 15 is placed directly between the skirt 3 and the sleeve 14.

The way in which the device D of FIG. 1 works is immediately obvious from the following explanations.

To apply lipstick using the stick B, having removed the cap 2 from the case 1, the metal sleeve 14 is held by a user and the base 7 is turned relative to the sleeve 14, so as to rotate the internal skirt 3. The sleeve 14 remains immobile with the casing member 9, and the cup 5 moves up inside the internal skirt 3 by the stubs 6 travelling along the helical grooves 13.

Should the user inadvertently turn the base 7 while the device is closed, the top of the stick B of lipstick will come into contact with the sealed face 20 of the first sealing means 18. However, the flexible sealed face 20 will deform, taking on the shape of that part of the stick with which it is in contact, and the stick B will not be damaged. Thus, this first sealing means 18 also makes it possible to preserve the shape of the stick of lipstick, avoiding any aesthetic damage to the stick when the device is actuated while it is closed.

Figure 2:
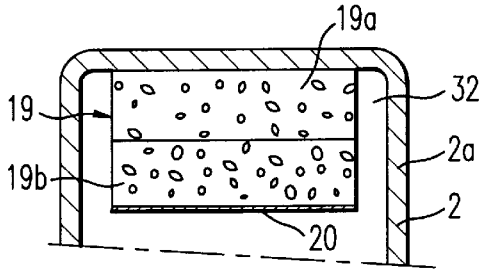
FIGS. 2 to 5 depict, in longitudinal section, various embodiments of part of the cap of an applicator, in accordance with the invention.

FIG. 2 shows an alternative form of the first sealing means which can be differentiated from that of FIG. 1 in the construction of the block of cellular material 19. Thus, the block of cellular material 19 is made in two parts 19*a*, 19*b*, each part 19*a*, 19*b* being of a different material which in particular has different deformation properties for different stresses. In particular, it is possible, for each part, to use a foam with a different density of open cells, giving it a defined flexibility. Such a structure of the block of cellular material makes it possible to vary the capacity of the block of cellular material for deformation under stress, thus making it possible to obtain variable flexibilities for the first sealing means when it is resting on the case. Furthermore, an annular space 32 between the block of cellular material 19 and the internal surface 2*a* of the cap 2 allows the block of cellular material 19 and the sealed face 20 to deform in a radial direction with respect to the axis X when resting on the case.

Figure 3:
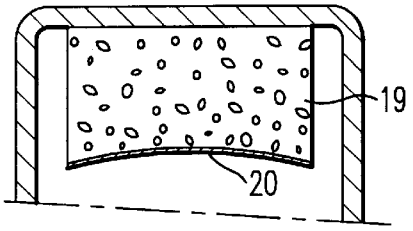
Figure 4:
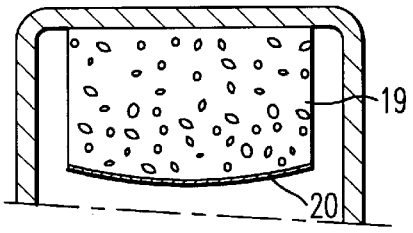
Figure 5:
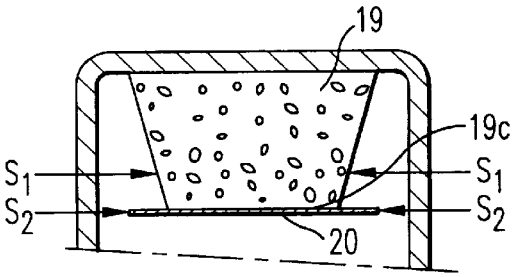

FIGS. 3 to 5 show three other alternative forms of the first sealing means, which can be differentiated from that of FIG.

1 in the shape of the block of cellular material 19. Thus, that part of the block of cellular material that comprises the sealed face 20 has a concave or convex profile as shown respectively in FIGS. 3 and 4. The block of cellular material 19 may also have a cross-section at right angles to the axis X which differs from the cross-section of the sealed face 20 as illustrated in FIG. 5. In this FIG. 5, the sealed face 20 is a film bonded to the block of cellular material 19 and the cross-section of the film 20 is greater than the cross-section of the surface 19*c* of the block of cellular material 19 in contact with the film 20. In particular, the block of cellular material 19, in axial section, has a trapezoidal shape, the shortest side of which corresponds to the surface 19*c* in contact with the sealed face 20.

Figure 6:
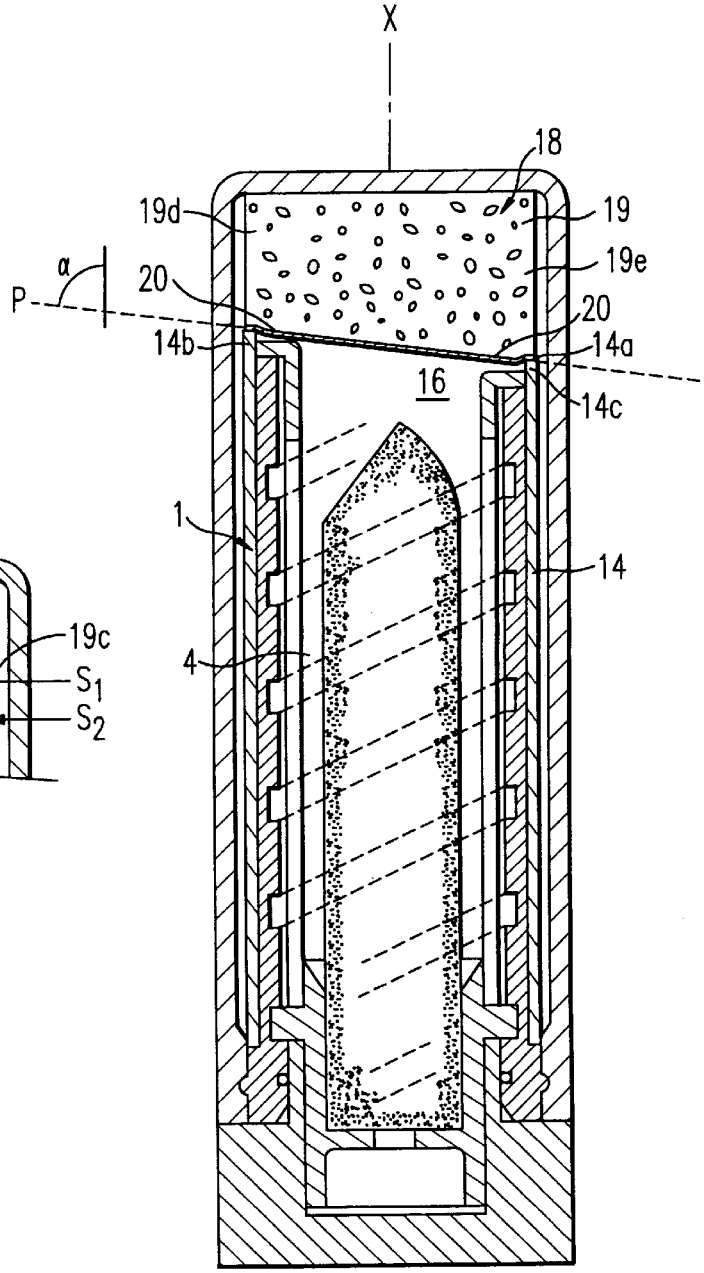
FIG. 6 is a longitudinal section through part of the cap of an applicator in accordance with a second alternative form of the invention.

FIG. 6 shows an alternative form of the invention, which can be differentiated from that of FIG. 1 in the fact that the open end of the case 1 and the edge 14*a* of the sleeve 14 define a plane P which is inclined by an angle a with respect to the axis longitudinal X. Thus, the open end 16 of the case 1 is in the shape of a bevel. The sealed face 20 of the first sealing means 18 is in sealed contact with the inclined edge 14*a* and the block of cellular material 19 deforms in such a way that it perfectly adapts to the inclined shape of the open end of the orifice 16. The compression of the block of cellular material 19 is not the same at every point around the inclined edge 14*a*. This is because the region 19*d* of the block of cellular material 19 in contact with the region 14*b* of the edge 14*a* undergoes greater compression than the region 19*e* of the block of cellular material 19 in contact with the region 14*c* of the edge 14*a*. The cellular structure of the block of cellular material 19 allows different compressions within the one same block of cellular material 19 and ensures that the sealed face 20 is held in close contact with the inclined edge 14*a*. Thus, despite the inclination of the opening 16 of the case 1, the volume containing the stick of product is correctly sealed. Such sealing could not be obtained with a bellows device of the type described in patent U.S. Pat. No. 5,533,823 discussed earlier.

Figure 7:
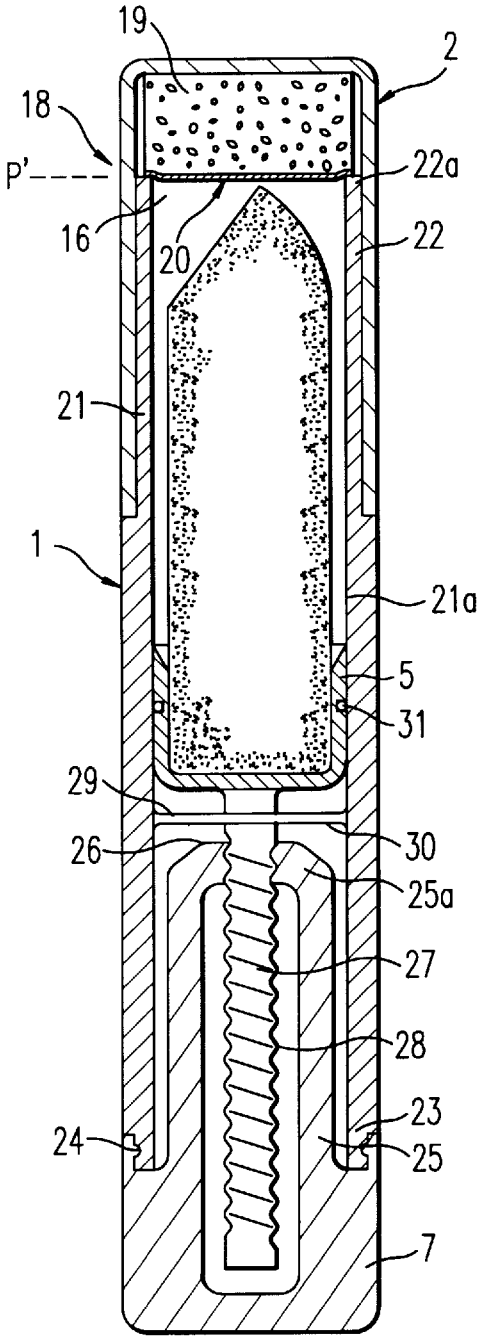
FIG. 7 is a longitudinal section of part of the cap of an applicator in accordance with a third alternative form of the invention.

FIG. 7 shows an alternative form of the invention which can be differentiated from that of FIG. 1 by the drive means capable of making the cup slide in the case. In this alternative form, the cup 5 is housed in a sheath 21 of tubular shape with an open first end 22 and an open second end 23. The first end 22 has an edge 22*a* delimiting the opening 16 of the case 1. The edge 22*a* defines a plane P' which is more or less perpendicular to the longitudinal axis X of the case. The second end 23 is held on the base 7 free to rotate by a bead/annular groove fixing means 24. The base 7 is extended, inside the sheath 21, by a tubular sleeve tube 25 which has an internal thread 26 at its end 25*a*. The cup 5 has a central rod 27 with two flats (not depicted) and an external screw thread 28 able to interact with the internal thread 26 in the sleeve tube 25.

A wall 29 with an oval-shaped orifice 30 is arranged between the two ends 22, 23. The rod 27 of the cup 5 passes through the orifice 30 in the wall 29 of the sheath 21. The rod 27 can be moved axially in terms of translation in the sheath 21 and it is prevented from rotating by the shape of the rod 27 and of the orifice 30. From the foregoing description it will be understood that by rotating the base 7 with respect to the sheath 21, the cup 5 can be made to slide as desired in the sheath 21. Furthermore, the cup 5 has an external surface 5*a* fitted with a seal 31 in sealed contact with the internal wall 21*a* of the sheath 21. Alternatively, the sealing may be under the cup 5, using a disc secured to the rod 27 and the periphery of which can sealedly slide fashion against the internal surface 21*a* of the sheath, as the cup 5 moves axially. Such a disc may be made of any appropriate elastomeric material whatsoever.

In a way similar to the device of FIG. 1, the cap 2 in its closed end has a first sealing means 18 comprising a block of cellular material 19 and a sealed face 20. When the device is closed, the sealed face 20 is in contact with the edge 22*a* of the end 22 and closes the opening 16 of the case 1 in a sealed manner. The seal 31 borne by the cup 5 provides sealing at the base of the stick B of product. The latter is thus housed in an airtight volume and keeps well over time.

Several non-limiting embodiments of the first sealing means will now be described below.

EXAMPLE 1

The block of cellular material 19 of the first sealing means is a cylinder of polyurethane foam with a height h, measured along the axis X, of 2 cm, and a diameter of 1 cm. The sealed face 20 is a disc of silicone 1 mm thick and with a diameter of 18 mm. Such a sealing means is suitable for closing off a case which has an orifice of outside diameter 17 mm (corresponding to the outside diameter of the sleeve 14 for a device in accordance with FIG. 1) and an inside diameter of 14 mm (corresponding to the inside diameter of the internal skirt 3 in accordance with the device of FIG. 1).

EXAMPLE 2

The block of cellular material 19 is a stack of two blocks of foam in accordance with that illustrated in FIG. 2. Each block of cellular material is a cylinder of polyurethane foam 9 mm thick and with a diameter of 19 mm. The density of open cells in the two blocks of cellular material differs. The sealed face 20 is a sheet of low density polyethylene (LDPE) 0.1 mm thick and has the same cross-section (with respect to the axis X) as the block of cellular material 19.

EXAMPLE 3

The block of cellular material 19 is as per the one in FIG. 4 and is made of open-cell silicone foam. The sealed face 20 is a skin made of the same material as the block of cellular material 19 with which it forms an integral part.

In the foregoing detailed description, reference was made to a preferred embodiment of the invention. It is obvious that variations can be made to this without departing from the spirit of the invention as claimed hereafter.

What is claimed is:

1. A device for packaging and applying a solid product in the form of a stick, comprising:

a case having a longitudinal axis and a first end, wherein said first end includes a free edge delimiting an exit orifice for said product, a cup supporting said stick inside the case, and a drive part capable of causing said cup to slide axially in said case;

a removable cap configured to close off said exit orifice, said cap being closed at one of its ends, wherein said cap includes a first seal element provided in the closed end of the cap, said first seal element having a sealed face which is substantially leaktight to the product, and which rests against said free edge of the case when said cap is provided on said case;

wherein said first seal element comprises at least one block of a cellular material which is elastically compressible in a plurality of directions, and an annular space between said block of cellular material and an internal surface of said removable cap, so as to allow said block to deform in at least a direction transverse to said longitudinal axis, whereby said sealed face creates a seal with said free edge of the case, said annular space extending from said sealed face towards the closed end of said cap on at least part of the height of said block.

2. A device according to claim 1, wherein said case comprises a second end opposite said first end, and a second seal element located between said stick and said second end.

3. A device according to claim 2, wherein said case further comprises an internal surface and wherein said second seal element comprises a member situated on or under said cup, said member being capable of sealedly sliding against the internal surface of said case.

4. A device according to claim 2, further comprising an internal skirt having at least one axial slot passing therethrough, said internal skirt being mounted to rotate freely inside a casing which has an internal surface that comprises at least one helical groove capable of accommodating at least one stub borne by said cup, through said axial slot, said drive part being capable of making said internal skirt rotate relative to said casing.

5. A device according to claim 4, wherein said second seal is placed near said second end, between said casing and said internal skirt, or between said internal skirt and an outer sleeve surrounding said casing.

6. A device according to claim 2, wherein said case further comprises a sheath, said cup being borne by an axial rod that has an external screw thread, said drive part being capable of rotating said rod with respect to said sheath.

7. A device according to claim 6, wherein said second seal is placed between said cup and said sheath, or under said cup, between said axial rod and said sheath.

8. A device according to claim 1, wherein said sealed face of said block of cellular material comprises a material which can be deformed in the direction of at least one axis which is more or less parallel to said longitudinal axis.

9. A device according to claim 1, wherein said sealed face of said block of cellular material comprises a material which can be deformed at least biaxially.

10. A device according to claim 1, wherein said sealed face comprises a membrane made of a different material from said cellular material of the block of cellular material.

11. A device according to claim 1, wherein said sealed face comprises a membrane formed of closed cells of a cellular material.

12. A device according to claim 11, wherein said membrane forms an integral part of said block of cellular material.

13. A device according to claim 11, wherein said membrane is fixed to said block of cellular material by bonding or by welding.

14. A device according to claim 1, wherein said sealed face is configured to deform such that when said cap is provided on said case, a region of said sealed face which rests on said free edge of said case has an annular depression.

15. A device according to claim 14, wherein said annular depression is substantially cup-shaped.

16. A device according to claim 14, wherein the deformation of the annular depression, measured along the longitudinal axis, ranges from 5/100ths of a mm to 5 mm.

17. A device according to claim 1, wherein said block of cellular material and said sealed face of said first sealing means respectively have first and second cross-sections, measured on a plane perpendicular to said longitudinal axis, said first cross-section at least over part of the axial height of said block being less than or equal to said second cross-section.

18. A device according to claim 17, wherein at least one of said first and second cross-sections have a shape of at least one of triangular, square, polygonal and circular.

19. A device according to claim 17, wherein the larger of the first and second cross-sections is approximately equal to the internal cross-section of the cap, measured on a plane perpendicular to said longitudinal axis.

20. A device according to claim 1, wherein said block of cellular material has a cross-sectional shape, measured on a plane parallel to said longitudinal axis, of at least one of straight-across, trapezoidal and inverted bitrapezoidal.

21. A device according to claim 1, wherein said block of cellular material is comprised of at least one part, wherein each part being made of an identical or different cellular material.

22. A device according to claim 1, wherein the cellular material of said at least one block of cellular material is at least one of polyethylene, polyvinyl chloride, polyurethane, polyether and silicone foams.

23. A device according to claim 1, wherein said sealed face is a film made of at least one of plastic film, aluminium film, complex metalo-plastic film, ceramic-plastic film and leather.

24. A device according to claim 23, when said sealed face is a plastic film, wherein said plastic film is at least one of elastomers, polyethylenes, polypropylenes, EVA, and EVOH.

25. A lipstick applicator, characterized in that it comprises a device according to claim 1.

* * * * *